US008123588B2

(12) United States Patent
Tyrer

(10) Patent No.: US 8,123,588 B2
(45) Date of Patent: Feb. 28, 2012

(54) BRASSIERE

(75) Inventor: John R. Tyrer, Rearsby (GB)

(73) Assignee: Laser Optical Engineering Limited (GB)

( * ) Notice: Subject to any disclaimer, the term of this patent is extended or adjusted under 35 U.S.C. 154(b) by 684 days.

(21) Appl. No.: 11/991,345

(22) PCT Filed: Aug. 24, 2006

(86) PCT No.: PCT/GB2006/003195

§ 371 (c)(1),
(2), (4) Date: Mar. 21, 2008

(87) PCT Pub. No.: WO2007/026136

PCT Pub. Date: Mar. 8, 2007

(65) Prior Publication Data

US 2009/0258571 A1 Oct. 15, 2009

(30) Foreign Application Priority Data

Sep. 2, 2005 (GB) ..... 0517896.7

(51) Int. Cl.
*A41C 3/00* (2006.01)
*A41F 19/00* (2006.01)

(52) U.S. Cl. ..... 450/86; 2/326; 2/327

(58) Field of Classification Search ..... 450/58, 450/62–64, 71–73, 77, 79, 85, 86, 88; 2/73, 2/326, 327

See application file for complete search history.

(56) References Cited

U.S. PATENT DOCUMENTS

| | | | | | |
|---|---|---|---|---|---|
| 2,118,378 | A * | 5/1938 | Graham | 2/328 |
| 2,455,036 | A * | 11/1948 | Boylan | 450/86 |
| 3,071,140 | A * | 1/1963 | Adler | 450/86 |
| 3,227,185 | A * | 1/1966 | Locascio | 450/86 |
| 3,311,112 | A * | 3/1967 | Murray | 450/1 |
| 3,860,046 | A * | 1/1975 | Goff et al. | 139/421 |
| 4,220,157 | A * | 9/1980 | Clark et al. | 450/86 |
| 4,324,254 | A * | 4/1982 | Freedman et al. | 450/70 |
| 5,626,507 | A | 5/1997 | Gillen | |
| 5,643,043 | A | 7/1997 | Pflum | |
| 6,302,761 | B1 * | 10/2001 | Wrenn | 450/86 |
| 7,118,444 | B2 * | 10/2006 | Newman | 450/58 |

FOREIGN PATENT DOCUMENTS

| | | |
|---|---|---|
| EP | 1005799 | 6/2000 |
| WO | WO/2006/065294 | 6/2006 |

* cited by examiner

*Primary Examiner* — Gloria Hale
(74) *Attorney, Agent, or Firm* — Renner Kenner; Greive Bobak; Taylor & Weber

(57) ABSTRACT

Brassieres are provided which provide enhanced levels of comfort and support to the wearer. In one aspect, the invention provides a brassiere comprising an elastic material and damping arrangement, wherein the damping arrangement is arranged so as to dampen movements of a strap of cup caused by movement of a breast. In another aspect there is provided a brassiere having a strap and cup arrangement which is configured to distribute the breast load. Also provided is a brassiere for constraining movement of a wearer's breasts during wear, wherein said brassiere is configured such that movement of one breast caused by movement of the wearer is restrained by a remaining breast.

30 Claims, 4 Drawing Sheets

BRASSIERE

FIELD OF THE INVENTION

This invention relates to a breast support, in particular a brassiere.

BACKGROUND TO THE INVENTION

Known brassieres support the breasts of a wearer by effectively damping a breast to the torso of a wearer, and thereby holding the breasts up. With the exception of strapless brassieres, most brassiere designs rely on a chest band to clamp around the wearer's chest and which has cup portions in front of the brassiere to contain the breast. The cups are further held in place by vertical straps which pass over the shoulders of the wearer and are usually attached to the chest band. Any attempt to tension the shoulder straps to transfer load upward across the shoulder results in the chest band riding up the back of the wearer. Such movements of the chest band result in discomfort to the wearer.

Certain brassiere designs have repositioned the vertical straps to eliminate the chest band and thereby eliminate the discomfort attendant with the use of such a band. One such brassiere includes straps which cross the back of the wearer and attach to the base of the other breast, thereby counterbalancing one breast by the other (see U.S. Pat. No. 3,071,140).

As well as the constant static load generated by the breast, the individual breasts undergo forced dynamic motion of the move or is moved. The dynamics of each breast can be represented in Cartesian coordinates (X, Y and Z) such as side to side, up and down and forward or backward. Each breast will undergo forced vibration which can result in oscillatory motion which can all be described by the Cartesian components of displacement. The vertical motion will act upon the center of mass of the breast and generate a cyclical vertical motion which is governed by the mass of the breast, the elasticity of the supporting tissue and the forcing frequency.

During bodily movements, associated movements of the breast or "breast bounce", as it is commonly known, can cause discomfort and/or embarrassment to the individual. Furthermore, to control breast movement in other axes, a combination of cup design and strapping of breasts to the upper body is generally employed. However, such known brassieres are often found to be uncomfortable by wearers. In addition, these known brassieres are generally unable to provide support without inhibiting movement of a wearer.

SUMMARY OF THE INVENTION

This invention is therefore aimed at providing a brassiere which overcomes at least some of the disadvantages of the known brassieres.

It has been found that the inclusion of a fabric sleeve around an elastic strap of a brassiere introduces damping to the support strap which damps any oscillations of the breast. This provides for adequate movement of the supported breast whilst allowing the wearer competence in reduced breast "bounce".

Accordingly, in a first aspect of the present invention there is provided a brassiere comprising:

(i) a first cup for supporting a first breast of a wearer;

(ii) a second cup for supporting a second breast of the wearer; and (iii) a first strap attached to the first cup for passing over a first shoulder of the wearer wherein the first strap and/or first cup are formed of elastic material;

wherein the brassiere comprises an elastic material and damping means, and wherein the damping means is arranged so as to damp movements of the first strap and/or cup caused by movement of a breast.

It has also been found that, by passing a first strap from a first cup over the first shoulder and across the back of the wearer to the second cup, the breast load can be distributed throughout the upper torso of the wearer. As a result, enhanced levels of comfort may be achieved while still providing the required degree of breast support.

According to a second aspect of the present invention there is provided a brassiere comprising:

(i) a first cup for supporting a first breast of a wearer;

(ii) a second cup for supporting a second breast of the wearer; and (iii) a first strap attached to the first cup for passing over a first shoulder of the wearer;

wherein the first strap is configured to pass across the back of the wearer for attachment to the second cup to thereby distribute the breast load.

According to a further aspect of the invention there is provided a brassiere for constraining movement of a wearer's breasts during wear comprising:

(i) a first and second cup each arranged to receive a respective breast of said wearer;

(ii) a first strap connected to an upper region of said first cup and a lower region of said second cup; and (iii) a second strap connected to an upper region of said second cup and to a lower region of said first cup;

wherein each of said straps is arranged to cross independently over the back of said wearer during wear whereby movement of one breast caused by movement of the wearer is restrained by a remaining breast.

DESCRIPTION OF VARIOUS EMBODIMENTS

Figure 1:
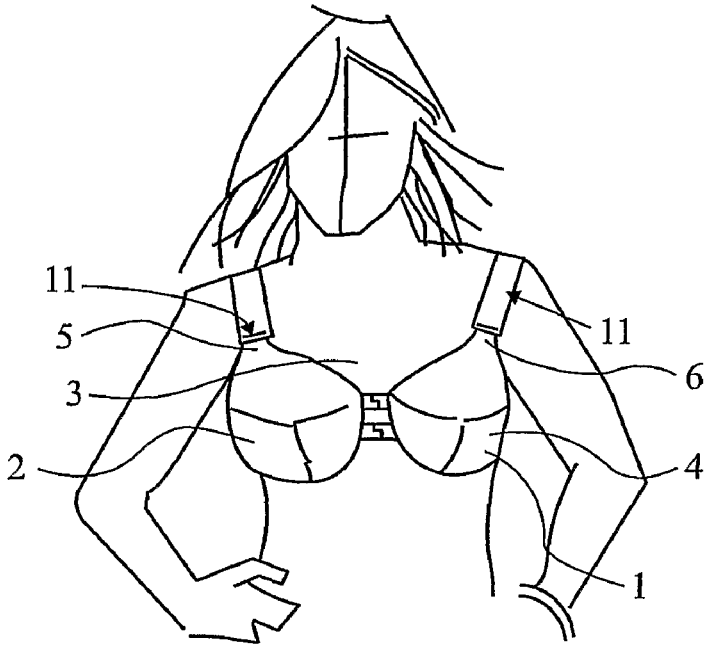
FIG. 1 is a schematic illustration from the front of a brassiere according to the invention being worn by a wearer.

Typically, a brassiere of the invention comprises a second strap for passing over a second shoulder of the wearer. The second strap is preferably similar to the first strap.

Regarding said first aspect, the damping means may be attached to the first strap and/or cup or may be integral with the strap and/or cup.

Damping can be achieved by various means, such as by friction generated between moving fibres or by use of substances composed within the straps which exhibit non-linear mechanical behaviour during movement. Methods to generate friction damping within a strap may be achieved with different types of material, different ways of constructing the strap with fibres, or differential surface finish between fibres selected to produce the necessary damping per unit length of the strap. If greater damping is required then greater lengths or areas of interaction may be used. Furthermore, multiple lay ups may be produced, for example, as a series of sleeves around a strap or multiple braiding of the material within a strap; thus a strap may be constructed with a series of individual or multiple sleeves around the strap or a multiple number of individual straps. Materials which exhibit non-linear mechanical behaviour during movement may utilise properties such as hysterisis to provide different rates of damping in extension and relaxation.

Preferably the damping means include a sleeve that is in frictional contact with the elastic material of said strap and/or cup. The sleeve may be a fabric sleeve. A preferred attachment of the sleeve is to an end of a strap either at the back end, for example, if the wearer wants a degree of adjustment at the front, or if the attachment is at the front then an adjusting slider may be present at the rear. Thus, when the wearer leans forward, the bust will move forward as the wearer stoops down.

The "elastic material" may comprise any material having suitable elastic or "springy" properties, for example stretchable knit fabric such as cotton.

As used herein, the term "sleeve" is intended to cover any arrangement of fabric which surrounds the strap(s) and/or cup(s). Preferably, the sleeve is in intimate or frictional contact with the strap(s) and/or cup(s). Suitable fabrics will be apparent to those skilled in the art.

The design and control of the interfacial friction along the strap is necessary to provide the critical level of damping. Under-damping will produce an amount of associated residual motion after the forcing function has stopped. Over-damping will result in local sheering between the skin and strap.

Increased levels of support may be obtained by increasing the level of tension in supporting straps. Matching of suitable elastic spring rate in the straps will ensure local sheering between the straps and the underlying skin of the wearer does not occur.

A brassiere of the invention may comprise a cushioning pad for placement between the first strap and the first shoulder of the wearer to distribute the breast load across the shoulder of the wearer and thereby prevent the strap from cutting into the tissue around the shoulder.

A brassiere of the invention may further comprise a strap member which encircles the chest of the wearer. The presence of such an additional chest band may provide a level of dynamic control for breast sway from side to side.

In a preferred embodiment, the first strap of the brassiere is configured to pass across the back of the wearer for attachment to the second cup to distribute the breast load. It has been found that, because the first strap passes from the first cup over the first shoulder and across the back of the wearer to the second cup, this arrangement helps to distribute the breast load throughout the upper torso of the wearer.

The bra cup allows control of the movement induced by displacement of the breast in all three axes; for/aft; side/side; up/down. The fabric lay-up of the cups allows the collection of the load and transfer to the straps. The cups are also able to expand and move with the breast during activity whilst continuing to provide support. The cup may be configured to gather and transfer the breast load and thereby provides support to the breast whilst allowing the breast to move during activity.

Said first aspect of the invention will be more clearly understood from the following description of an embodiment thereof, given by way of example only, with reference to FIGS. 1 to 4.

Figure 2:
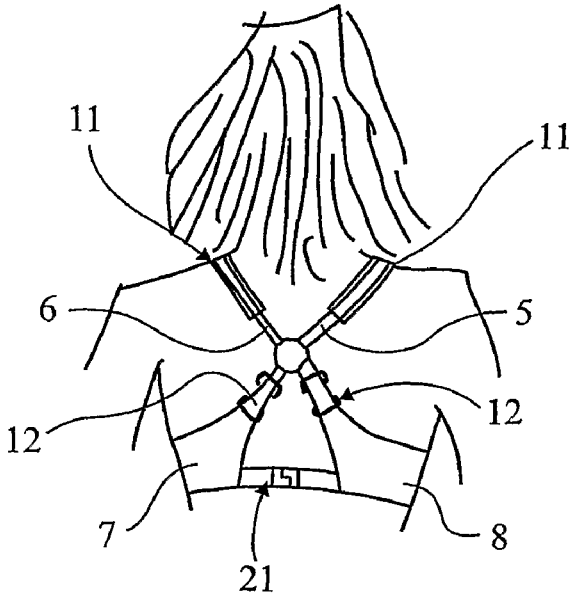
FIG. 2 is a schematic illustration from the rear of the brassiere of FIG. 1 being worn by the wearer.

Referring to FIGS. 1 and 2, there is illustrated a brassiere 1 comprising a first cup 2 for supporting a first breast of a wearer 3, a second cup 4 for supporting a second breast of the wearer 3, and two straps 5, 6.

The straps 5, 6 are of a springy material to provide comfort to the wearer 3. In addition the straps, 5, 6 are surrounded by sleeves 11 manufactured from a dampening material to minimize breast movement during activity.

In addition, the arrangement of the straps 5, 6 acts to counterbalance the mass of one breast against the base of the other breast. In this way, movement of one breast is inhibited by the mass of the other breast.

As illustrated in FIG. 2, the straps 5, 6 overlap across the back of the wearer 3. The first strap 5 is attached to the first cup 2 of the brassiere 1 at an upper, central region of the first cup 2 (FIG. 1). The first strap 5 is also attached to the second cup 4 at a lower, side region 7 of the second cup 4 (FIG. 1). Similarly, the second strap 6 is attached to the second cup 4 at an upper, central region of the second cup 4 (FIG. 1). The second strap 6 is also attached to the first cup 3 at a lower, side region 8 of the first cup 3 (FIG. 1). The straps 5, 6 are not connected to one another as they cross one another across the back of the wearer 3. In addition the straps 5, 6 are movable relative to one another.

The level of tension in the straps 5, 6 may be adjusted using rear adjustment means 12, to increase the level of support.

It will be appreciated that the straps 5, 6 may be attached to the cups 2, 4 by any suitable means, such as releasable attachment means.

Figure 4A:
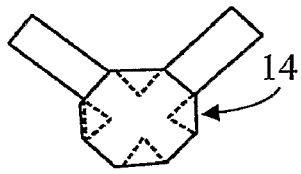
FIG. 4 is a schematic illustration from the rear of the brassiere of FIG. 3 being worn by the wearer.
Figure 4:
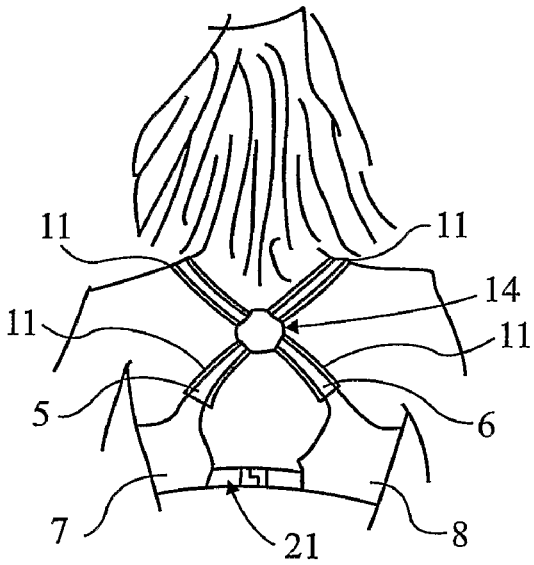

The brassiere 1 further comprises a third strap 21 attached to the first cup 2 at the lower, side region 8 of the first cup 2, and attached to the second cup 4 at the lower, side region 7 of the second cup 4 (FIG. 4). In use, the third strap 21 is looped around the back of the wearer 3 from the first cup 2 to the second cup 4. In this manner the third strap 21 assists in maintaining the cups 2,4 located around the breasts, for example if the wearer 3 leans forward.

Figure 3:
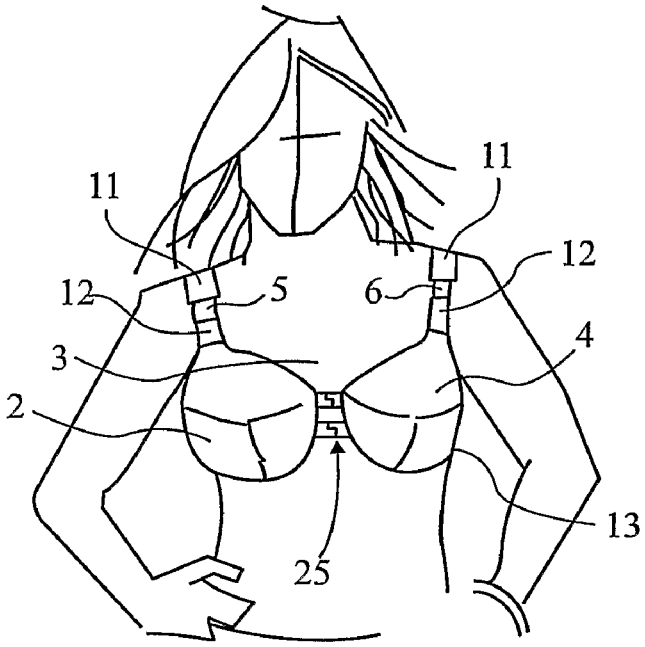
FIG. 3 is a schematic illustration from the front of another brassiere according to the invention being worn by a wearer.

Referring to FIGS. 3 and 4, there is illustrated another brassiere 13 according to the invention, which is similar to the brassiere 1 of FIGS. 1 and 2, and similar elements in FIGS. 3 and 4 are assigned the same reference numerals.

The first cup 2 is releasably attached to the second cup 4 at a central, front attachment point 25 (FIG. 3) to enable the wearer 3 to put-on and take-off the brassiere 13 in a simple, ergonomic manner. Because the breast load is supported by the tension in the straps 5,6, the subjection of the brassiere 13 to horizontal tensile forces is inhibited. Thus the central, front attachment point 25 may be employed without the cups 2,4 being subjected to tensile forces tending to pull the cups 2,4 apart.

As illustrated in FIG. 3, the positions of the straps 5, 6 can be adjusted using front adjustment means 12, to enable the wearer 3 to find the most comfortable, supported position.

As illustrated in FIG. 4, straps 5, 6 overlap across the back of the wearer 3. Again, the straps 5, 6 are attached independently of one another as they cross one another across the back of the wearer. In addition, the straps 5, 6 are movable relative to one another. In the embodiment of FIGS. 3 and 4, this is achieved by a cross-piece arrangement 14 of sleeves 11, in which the sleeves are crossed and fixed in place relative to one another; although the sleeves are fixed, the design is such that straps 5, 6 are able to slide freely through sleeves 11.

A brassiere according to said second aspect of the invention supports the breasts by counterbalancing the mass of one breast via an arrangement of straps against the base of the other breast. The breast load is transferred via the straps across the shoulders and across the back. In this way movement of one breast is inhibited by the mass of the other. This arrangement of the straps also provides improved posture and more effective load distribution.

In such a brassiere, the straps perform a lifting action to support the breasts. In particular, it is not necessary to clamp the breasts to the torso of a wearer using the brassiere to achieve the required degree of support.

The straps may be of a springy material to provide comfort to the wearer. The straps may be manufactured from a dampening material to minimise breast movement during activity. The strap may incorporate a spring and damper "intelligent strap". Increased levels of support may be obtained by increasing the level of tension in the supporting straps.

The bra cup allows control of the movement induced by displacement of the breast in all three axes: fore/aft; side/side; up/down. The fabric lay-up of the cups allows for collection of the load and transfer to the straps. The cups are also able to expand and move with the breast during activity while continuing to provide support. The cup may be configured to gather and transfer the breast load and thereby provide support to the breast while allowing the breast to move during activity.

Said second aspect of the invention will be more clearly understood from the following description of an embodiment thereof, given by way of example only, with reference to FIGS. 5 to 8.

Figure 5:
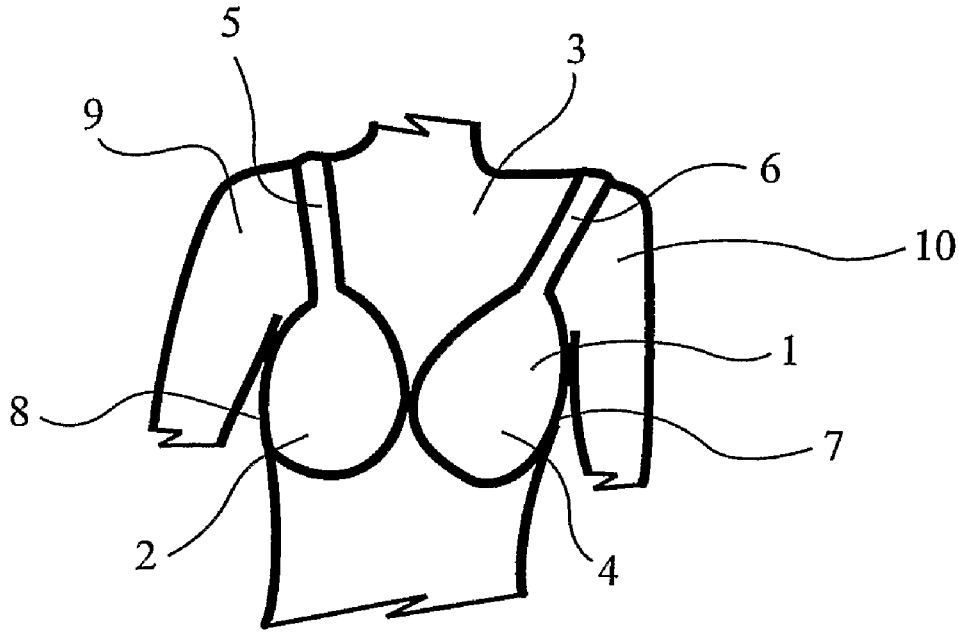
FIG. 5 is a schematic illustration from the front of a brassiere according to the invention being worn by a wearer.
Figure 6:
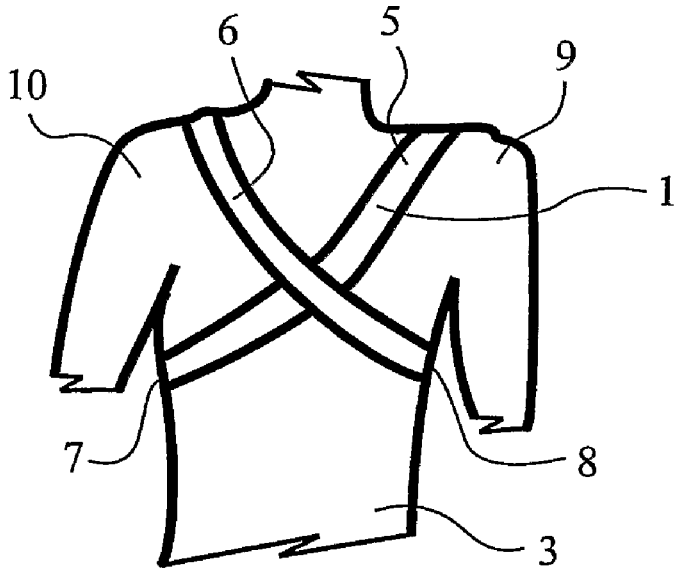
FIG. 6 is a schematic illustration from the rear of the brassiere of FIG. 5 being worn by the wearer.

Referring to FIGS. 5 and 6, thereof, there is illustrated a brassiere 1 comprising a first cup 2 for supporting a first breast of a wearer 3, a second cup 4 for supporting a second breast of the wearer 3, and two straps 5, 6.

The fabric lay-up of the cups 2, 4 enables the breast load to be collected and thus transferred to the straps 5, 6. Furthermore the cups 2, 4 are expandable to enable the cups 2, 4 to move with the breast during activity while continuing to provide support.

The straps, 5, 6 are of a springy material to provide comfort to the wearer 3. In addition the straps 5, 6 are manufactured from a dampening material to minimize breast movement during activity.

The first strap 5 is attached to the first cup 2 of the brassiere 1 at an upper, central region of the first cup 2 (FIG. 5). The first strap 5 is also attached to the second cup 4 at a lower, side region 7 of the second cup 4 (FIG. 5).

In a similar manner, the second strap 6 is attached to the second cup 4 of the brassiere 1 at an upper, central region of the second cup 4 (FIG. 5), and the second strap 6 is attached to the first cup 2 at a lower, side region 8 of the first cup 2 (FIG. 5).

In use, the first strap 5 is passed over a first shoulder 9 of the wearer 3 (FIG. 5), passed across the back of the wearer 3 diagonally downwardly (FIG. 6), and attached to the second cup 4 at the lower, outer corner 7 (FIG. 5). Similarly, the second strap 6 is passed over a second shoulder 10 of the wearer 3 (FIG. 5), passed across the back of the wearer 3 diagonally downwardly (FIG. 6), and attached to the first cup 2 at the lower, outer corner 8 (FIG. 5). In this manner, the brassiere 1 assists in distributing the breast load throughout the upper torso of the wearer 3.

In addition, the arrangement of the straps 5, 6 acts to counterbalance the mass of one breast against the base of the other breast. In this way, movement of one breast is inhibited by the mass of the other breast.

As illustrated in FIG. 6, the straps 5, 6 overlap across the back of the wearer 3. The straps 5, 6 are not connected to one another as they cross one another across the back of the wearer 3. In addition the straps 5, 6 are movable relative to one another.

The level of tension in the straps 5, 6 may be adjusted as required to increase the level of support.

It will be appreciated that the straps 5, 6 may be attached to the cups 2, 4 by any suitable means, such as releasable attachment means.

Figure 7:
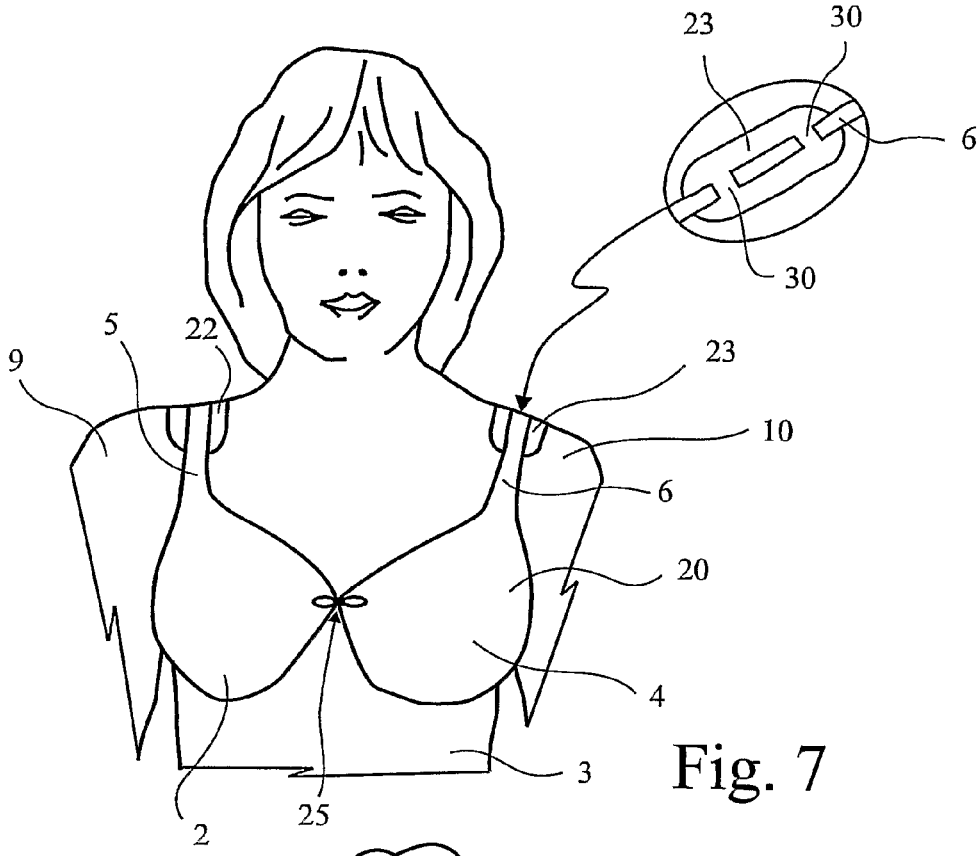
FIG. 7 is a schematic illustration from the front of another brassiere according to the invention being worn by a wearer.
Figure 8:
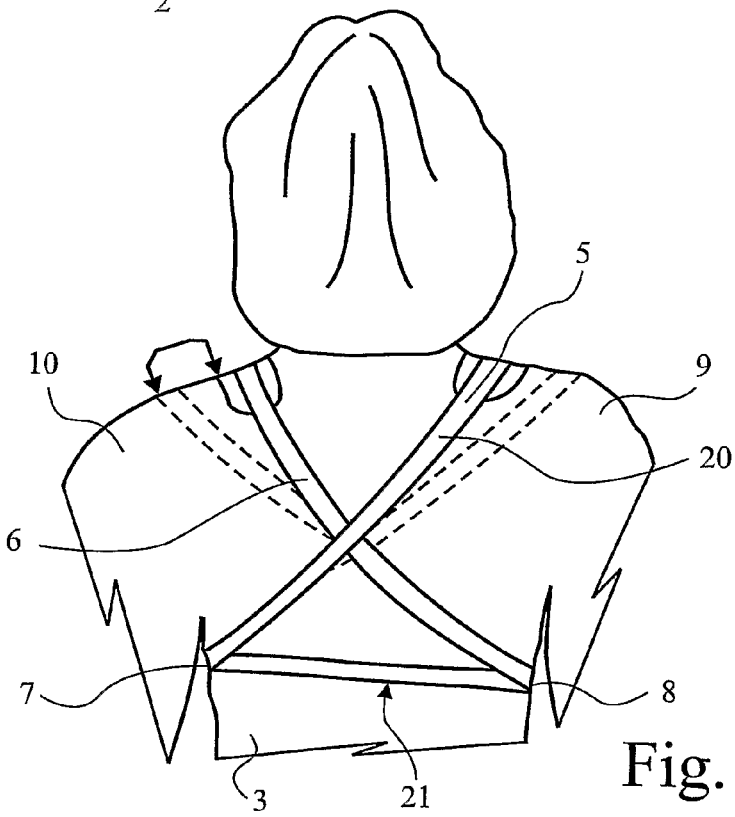
FIG. 8 is a schematic illustration from the rear of the brassiere of FIG. 7 being worn by the wearer.

Referring to FIGS. 7 and 8 there is illustrated another brassiere 20 according to the invention, which is similar to the brassiere 1 of FIGS. 5 and 6, and similar elements in FIGS. 7 and 8 are assigned the same reference numerals.

The first cup 2 is releasably attached to the second cup 4 at a central, front attachment point 25 (FIG. 7) to enable the wearer 3 to put-on and take-off the brassiere 20 in a simple, ergonomic manner. Because the breast load is supported by the tension in the straps 5,6, the brassiere 20 is not subjected to horizontal tensile forces. Thus the central, front attachment point 25 may be employed without the cups 2,4 being subjected to tensile forces tending to pull the cups 2,4 apart.

The brassiere 20 comprises a third strap 21 attached to the first cup 2 at the lower, side region 8 of the first cup 2, and attached to the second cup 4 at the lower, side region 7 of the second cup 4 (FIG. 8). In use, the third strap 21 is looped around the back of the wearer 3 from the first up 2 to the second cup 4. In this manner the third strap 21 assists in maintaining the cups 2,4 located around the breasts, for example if the wearer 3 leans forward.

The brassiere 20 comprises a cushioning pad 23 for placement between the second strap 6 and the second shoulder 10 of the wearer 3 to distribute the breast load across the shoulder 10 of the wearer 3, and thereby prevent the strap 6 from cutting into the tissue around the shoulder 10, as illustrated in FIGS. 7 and 7(*a*). The second strap 5 is looped through two eyelets 30 in the cushioning pad 23 to assist in keeping the cushioning pad 6 in position relative to the second shoulder 10 of the wearer 3. A cushioning pad 22 is similarly provided at the first shoulder 9 of the wearer 3.

As illustrated in FIG. 8, the positions of the straps 5, 6 as they pass across the back of the wearer 3 are adjustable to enable the wearer 3 to find the most comfortable, supported position.

The invention is not limited to the embodiments hereinbefore described, with reference to the accompanying drawings, which may be varied in construction and detail. Features of embodiments described herein, in particular those described in relation to FIGS. 1 to 8, may be combined to provide further embodiments.

The invention claimed is:

1. A brassiere comprising:

(i) a first cup for supporting a first breast of a wearer;

(ii) a second cup for supporting a second breast of the wearer;

(iii) a first strap attached to the first cup for passing over a first shoulder of the wearer, the first strap comprising an elastic material surrounded by a sleeve that is in frictional contact with the elastic material, the sleeve extending over a majority of a length of the first strap; and (iv) a second strap attached to the second cup for passing over a second shoulder of the wearer, the second strap comprising an elastic material surrounded by a sleeve that is in frictional contact with the elastic material, the sleeve extending over a majority of a length of the second strap, wherein the second strap is configured to pass across a wearer's back for attachment to the first cup to distribute the breast load;

wherein the frictional contact between the sleeves and the elastic materials is such as to provide damping means arranged so as to damp movement of at least one of the straps and the cups caused by movement of a breast.

2. A brassiere according to claim 1, wherein the sleeve is a fabric sleeve.

3. A brassiere according to claim 1, wherein the first strap is configured to pass across the back of the wearer for attachment to the second cup to distribute the breast load.

4. A brassiere according to claim 1, wherein the first strap is attached to the first cup at an upper region of the first cup.

5. A brassiere according to claim 1, wherein the first strap is attached to the second cup at a lower region of the second cup.

6. A brassiere according to claim 5, wherein the first strap is attached to the second cup at a lower, side region of the second cup.

7. A brassiere according to claim 1, wherein the first strap is releasably attached to the first cup.

8. A brassiere according to claim 1, wherein the first strap is releasably attached to the second cup.

9. A brassiere according to claim 1, wherein the first strap and the second strap are configured to overlap across the back of the wearer.

10. A brassiere according to claim 1, wherein the first strap is movable relative to the second strap.

11. A brassiere according to claim 1, wherein the first strap and the second strap are mutually disconnected across the back of the wearer.

12. A brassiere according to claim 1, wherein the second strap is attached to the second cup at an upper region of the second cup.

13. A brassiere according to claim 1, wherein the second strap is attached to the first cup at a lower region of the first cup.

14. A brassiere according to claim 13, wherein the second strap is attached to the first cup at a lower, side region of the first cup.

15. A brassiere according to claim 1, wherein the second strap is releasably attached to the second cup.

16. A brassiere according to claim 1, wherein the second strap is releasably attached to the first cup.

17. A brassiere according to claim 1, wherein the brassiere comprises a third strap for looping around the back of the wearer from the first cup to the second cup.

18. A brassiere according to claim 17, wherein the third strap is attached to the cup at a lower region of the cup.

19. A brassiere according to claim 18, wherein the third strap is attached to the cup at a lower, side region of the cup.

20. A brassiere according to claim 17, wherein the third strap is releasably attached to the cup.

21. A brassiere according to claim 1, wherein the brassiere comprises a cushioning pad for location between the strap and a shoulder of the wearer.

22. A brassiere according to claim 21, wherein the cushioning pad is spatially associated with the strap.

23. A brassiere according to claim 22, wherein the cushioning pad comprises one or more eyelets through which the strap may pass.

24. A brassiere according to claim 1, wherein the first cup is releasably attached to the second cup.

25. A brassiere comprising:

(i) a first cup for supporting a first breast of a wearer;

(ii) a second cup for supporting a second breast of the wearer;

(iii) a first strap attached to the first cup for passing over a first shoulder of the wearer, the first strap comprising an elastic material surrounded by a sleeve that is in frictional contact with the elastic material, the sleeve extending over a majority of a length of the first strap; and (iv) a second strap attached to the second cup for passing over a second shoulder of the wearer, the second strap comprising an elastic material surrounded by a sleeve that is in frictional contact with the elastic material, the sleeve extending over a majority of a length of the second strap, wherein the second strap is configured to pass across a wearer's back for attachment to the first cup to distribute the breast load;

wherein the first strap is configured to pass across the back of the wearer for attachment to the second cup to thereby distribute the breast load.

26. A brassiere according to claim 25, wherein the first strap or the second cup is attached to the first cup at an upper region of the first cup.

27. A brassiere according to claim 25, which comprises a third strap for looping around the back of the wearer from the first cup to the second cup.

28. A brassiere for constraining movement of a wearer's breasts during wear comprising:

(i) a first and second cup each arranged to receive a respective breast of said wearer;

(ii) a first strap connected to an upper region of said first cup and a lower region of said second cup, the first strap comprising an elastic material surrounded by a sleeve that is in frictional contact with the elastic material, the sleeve extending over a majority of a length of the first strap; and (iii) a second strap connected to an upper region of said second cup and to a lower region of said first cup and passing over a second shoulder of the wearer, the second strap comprising an elastic material surrounded by a sleeve that is in frictional contact with the elastic material, the sleeve extending over a majority of a length of the second strap, wherein the second strap is configured to pass across a wearer's back for attachment to the first cup to distribute the breast load;

wherein each of said straps is arranged to cross independently over the back of said wearer during wear whereby movement of one breast caused by movement of the wearer is restrained by a remaining breast.

29. A brassiere according to claim 28, wherein said first strap has a first end region connected to an upper central region of said first cup and a further end region connectable to a lower side region of said second cup.

30. A brassiere comprising:

(i) a first cup for supporting a first breast of a wearer;

(ii) a second cup for supporting a second breast of the wearer;

(v) a first strap attached to the first cup for passing over a first shoulder of the wearer and across the wearer's back for attachment to the second cup; and (vi) a second strap attached to the second cup for passing over a second shoulder of the wearer and across the wearer's back for attachment to the first cup;

wherein the first and second straps are elastic and are each provided with damping means in the form of a sleeve that is in frictional contact with its associated strap, each sleeve extending over a majority of a length of its associated strap; allowing each strap to move in damped manner relative to its sleeve without local shearing between the strap and underlying skin of the wearer.

* * * * *